United States Patent [19]

Mills, III

[11] 4,315,515

[45] Feb. 16, 1982

[54] TOBACCO DRYING APPARATUS

[75] Inventor: Luther J. Mills, III, Louisville, Ky.

[73] Assignee: Brown & Williamson Tobacco Corporation, Louisville, Ky.

[21] Appl. No.: 139,536

[22] Filed: Apr. 11, 1980

[51] Int. Cl.[3] ..... A24B 3/00; A24B 3/12

[52] U.S. Cl. ..... 131/303; 131/304; 131/306

[58] Field of Search ..... 131/133, 134, 135, 136, 131/137, 138, 290, 300, 302, 303, 304, 306; 34/50

[56] References Cited

U.S. PATENT DOCUMENTS 3,299,526 1/1967 Arnold et al. ..... 34/50

3,357,436 12/1967 Wright ..... 131/135

OTHER PUBLICATIONS

Chemical Engineers Handbook by Perry, 4th Edition McGraw Hill Book Co., published 1962, pp. 22–37 and pp. 22–103.

*Primary Examiner*—V. Millin

*Attorney, Agent, or Firm*—Charles G. Lamb

[57] ABSTRACT

An apparatus for drying tobacco under relatively high absolute humidity drying conditions to increase the filling power of tobacco.

6 Claims, 1 Drawing Figure

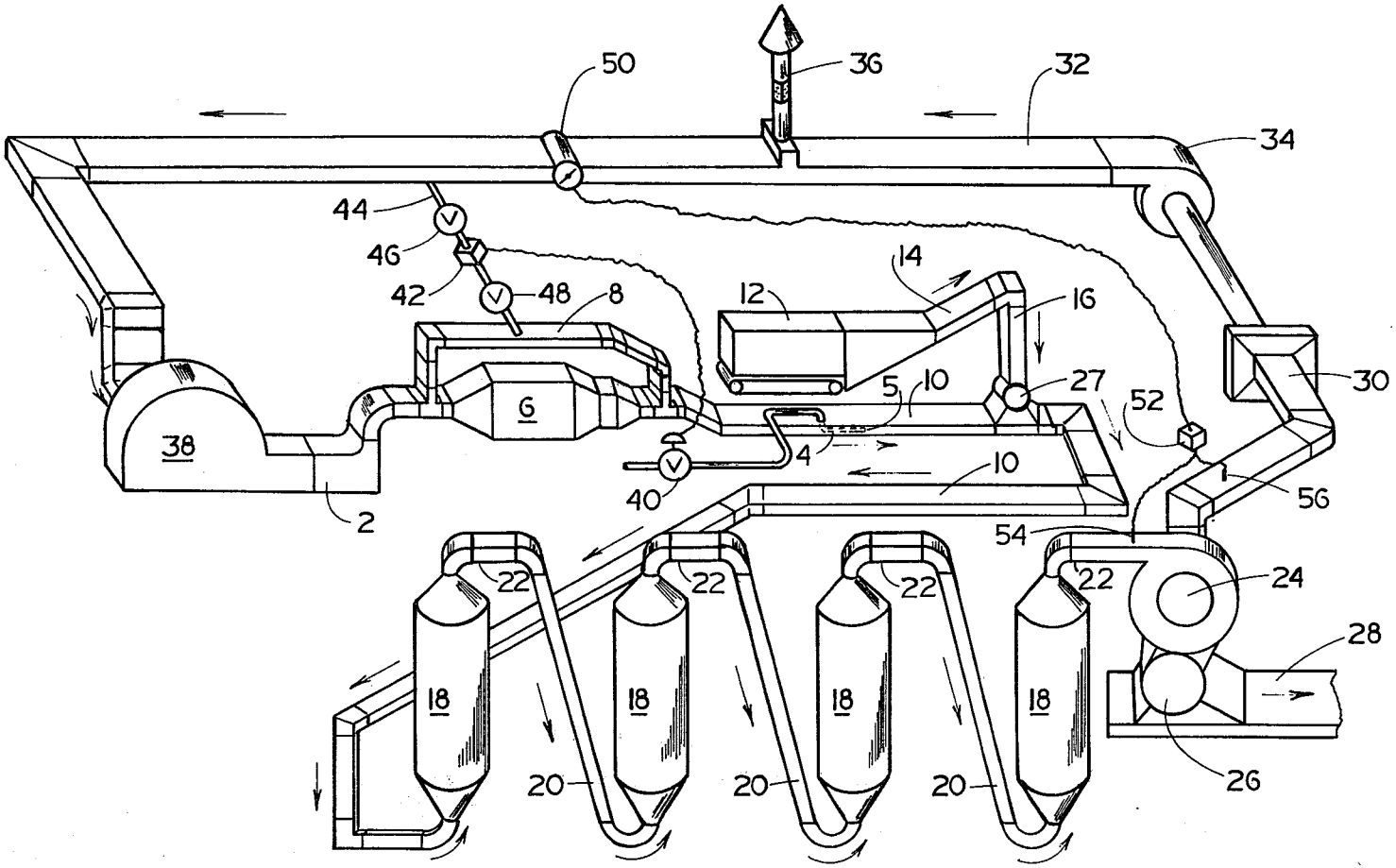
30
34
32
36
50
56
52
16
27
14
10
5
4
12
8
48
6
42
46
44
40
2
38
24
28
26
54
22
18
20

TOBACCO DRYING APPARATUS

BACKGROUND OF THE INVENTION

1. Field of the Invention

The invention relates to an apparatus for drying tobacco and more particularly relates to an apparatus for drying tobacco under relatively high humidity drying conditions.

2. Brief Description of the Prior Art

It is common practice in the manufacture of cigarettes to cut tobacco, which includes both lamina and stems, to a particle size which is appropriate in the manufacturing of cigarette products. In the processing of the tobacco prior to the cutting or shattering, the moisture content of the tobacco is generally increased in order to minimize shattering of the tobacco particles during the cutting step, and also provides a material of a more uniform particle size. As the processing of the tobacco continues, it is necessary to reduce this moisture content prior to the formation of a cigarette rod which is subsequently cut to prescribed lengths and made into a cigarette product.

In the drying of the previously cut tobacco, the initial moisture content usually ranges from about 15 to 35 percent for the lamina, and from about 20 to 60 percent for the stem. This tobacco is dried in the presence, generally, of hot air until the moisture is in the range of from about 12 to 15 percent. Several devices are known in the prior art and two examples of drying cut tobacco are disclosed in U.S. Pat. No. 3,357,436 and U.S. Pat. No. 4,167,191.

In recent years, it has become a widespread practice in the tobacco industry to expand or "puff" tobacco prior to incorporation into a cigarette product. This expansion or "puffing" leads to better economics as well as a lowering of the tar and nicotine in the final product. Many different techniques are described and known in the prior art for expanding tobacco, such as impregnation of the tobacco with water, an organic liquid, carbon dioxide, or ammonia, and then subjecting the impregnated tobacco to temperatures or pressures sufficient to then liberate the impregnant from the tobacco. However, in many of the drying techniques utilized for expanding the tobacco, many of the advantages attributed to the expansion technique are lost because of the shrinking during the drying process. Thus, an apparatus which may be utilized to dry expanded tobacco wherein the shrinkage does not occur or is minimized, is of substantial benefit in the processing of expanded tobacco particles.

SUMMARY OF THE INVENTION

In the present invention, it is recognized that it is desirable to provide an improved apparatus for the drying of expanded tobacco. Furthermore, it is recognized that it is desirable to provide an apparatus for drying tobacco at a temperature above 250° F. in the presence of an absolute humidity at a level above that which will provide a wet-bulb temperature reading of at least about 150° F., this condition being referred to as under "high humidity conditions." Even further, it is recognized that it is desirable to provide an apparatus for drying tobacco which minimizes shattering during the drying process. Also, it is recognized that it is desirable to provide an apparatus for drying expanded tobacco with a minimum amount of shrinkage.

Various other features of the present invention will become obvious to those skilled in the art of reading the disclosures set forth hereinafter.

More particularly, the present invention provides an apparatus for humidifying air and drying tobacco comprising: means for circulating the air in a substantially closed system; means for heating the air in this system; means for introducing tobacco at one end of the system and in the path of heated air; means in advance of the tobacco introduction station for injecting steam into the air stream downstream of the means for heating the air in the system; means in the system at a point beyond the tobacco introduction station in which the tobacco is conveyed upwardly by the hot moisturized air; means for separating the tobacco from the conveying air; exhaust means for discharging moisture-ladened air from the system; and sensing means for sensing the temperature of the air and its humidity following the discharge of the tobacco, said sensing means regulating the amount of steam being injected into the system.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

The FIGURE is a schematic flow diagram for a preferred apparatus of the invention.

DETAILED DESCRIPTION OF THE INVENTION

Referring to the FIGURE in carrying out the present invention, air is carried by closed duct 2 through a closed heater 6 and the exiting heated air flows into conduit 10. A heater by-pass duct 8 may be automatically or manually valved to by-pass air around the heater 6, providing a means of regulating the temperature of the air entering conduit 10. The capacity of heater 6 and the design of by-pass duct 8 is advantageously such that the temperature of air in conduit 10 is maintained within a pre-selected temperature range generally above 250° F. The air carried by or through conduit 10 passes steam entry port 4, through which steam or a mixture of steam-air may be injected into the air stream. The steam injection port 4, which includes a nozzle 5 at the terminating end thereof, injects steam into the air stream at an angle of less than 45° of the direction of flow of the air. As shown in the FIGURE, the steam enters the air stream substantially parallel to the flow of the air. The steam introduced through entry port 4 is advantageously adjusted by automatic control of steam control valve 40 to maintain a relatively high pre-selected humidity in the conduit 10. Steam control valve 40 is operated in response to the wet-bulb temperature of the air flowing in conduit 32, a wet-bulb sensing device being noted by the numeral 42. The wet-bulb sensing device is disposed in sample line 44 which is connected between conduit 32 and heater by-pass duct 8. A pair of valves 46 and 48 are disposed on opposite sides of wet-bulb sensing device 42 to adjust flow rate and to shut off the flow of air therethrough for on line calibration and maintenance.

Expanded tobacco is conveyed from supply hopper 12 by supply conveyer 14 to vertical pipe 16 into air lock 27 then into conduit 10. Other times the tobacco supply means may, of course, be used to bring expanded tobacco into the intimate admixture with the hot, high humidity air within conduit 10. It is realized that in some devices a conduit 10 is not needed as the tobacco may be fed directly into the air flow stream as it enters an expansion chamber 18, to be discussed hereinafter. The air entrained expanded tobacco is then carried through a plurality of drying chambers 18 and connecting ducts 20. However, it is realized that in some applications only one chamber 18 is needed and in even other applications drying may be accomplished in the conveying conduits, such as conduit 10. The chambers 18 are expansion chambers for reducing the velocity of the air flow through the apparatus as well as a dryer means, to effect drying of the air entrained expanded tobacco to the desired moisture level. The chambers 18 may be selected to have a capacity sufficient to maintain the desired temperature range of the air flow, usually from about 250° F. to about 650° F. The number of chambers 18 may be selected to provide any desired residence time for any degree of drying desired.

Expanded tobacco and air exiting from the last chamber 18 is carried through duct 22 to a separator 24. The separator 24 is preferably a tengential separator. It will be appreciated, however, that other types of separators may be used. Tobacco exits from separator 24 through airlock 26 and is conveyed to the next tobacco processing stage by conveyor 28. The separated exhaust air is recycled through ducts 30 and 32. A fan 34 is interposed within the ductwork to motivate the air. Also, an exhaust port 36 is positioned in the duct 32 to exhaust excess air from the system. Air carried through duct 32 re-enters duct 2 through a final separator 38, which removes any dust from the airstream. Preferably, separator 38 is a rotoclone type of separator, which also assists in motivating the air. In the FIGURE, the arrows show the flow direction of the expanded tobacco and/or air. Inasmuch as the amount of moisture removed from a particular tobacco, types of tobacco, blends of tobacco and form thereof will vary, the operating parameters of the process of the invention will vary, accordingly, in producing a uniform and constant moisture content of tobacco discharged from the system.

In order to control the flow through the system, a damper 50 is provided in the recycle conduit 32. Damper 50 is operated in response to the pre-selected pressure of pressure sensing device 52. Pressure sensing device 52 includes a pair of pressure sensing probes 54 and 56 which are disposed in the air stream, on opposite sides of tobacco separator 24. Each probe measures the pressure of the air stream at the pre-selected position and the differential pressure as received by the pressure sensing device 52 determines the opening or closing position of the damper 50.

The quantity of heat required for drying the tobacco will be dependent upon the rate at which the tobacco is fed through the system and upon its initial moisture content. An increase in either the said rate or content will tend to produce a reduction of air temperature in the conduit 10 and chambers 18, so that the heat input in heater 6 will of necessity have to be increased. Similarly, a reduction in feed rate or moisture content will produce a reduction in the heat input. Accordingly, the heat input will be so proportioned, depending upon the conditions, that the final moisture content of the tobacco will be maintained constant.

In the operation of the apparatus of the present invention, the temperature of the inlet air passing through conduit 10 will generally range from between 250° F. and 650° F., and in some cases may exceed 650° F. The expanded tobacco entering conduit 10 may be as high as 215° F. but this entering tobacco temperature is not critical and will depend upon the type and condition of tobacco used. The temperature of air emanating from the last chamber 18 will generally range from 170° F. to less than 600° F. Thus, the tobacco, after initial exposure to air temperatures of 250° F. to 650° F., will then be subjected to cooler air at 170° F. to less than 600° F. After exit of the dried tobacco, it may be cooled further as desired.

The residence time of expanded tobacco in the drying step of the invention may be terminated when the desired moisture level is reached. Exact drying times may be readily ascertained by trial and error for any given expanded tobacco.

It will be realized that various changes may be made to the specific embodiment shown without departing from the scope and spirit of the present invention.

What is claimed is:

1. An apparatus for humidifying air and drying tobacco comprising:

means for circulating the air in a substantially closed system;

means for heating the air in this system;

means for introducing tobacco at one end of the system and in the path of heated air;

means in advance of the tobacco introduction station for injecting steam into the air stream downstream of the means for heating the air in the system, said steam introduction being substantially parallel to the air stream;

means in the system at a point beyond the tobacco introduction station in which the tobacco is conveyed upwardly by the hot moisturized air;

means for separating the tobacco from the conveying air;

exhaust means for discharging moisture-ladened air from the system; and, sensing means for sensing the temperature of the air and its humidity following the discharge of the tobacco, said sensing means regulating the amount of steam being injected into the system.

2. The apparatus of claim 1, said sensing means including a wet-bulb sensing device.

3. The apparatus of claim 1 wherein said means for injecting steam includes a steam injection port disposed within the air stream.

4. The apparatus of claim 1, said sensing device being in actuating relation with a control valve means disposed within a steam injecting conduit, said conduit being in flow relation with a steam injection port disposed within the air stream.

5. The apparatus of claim 1 including means in the system at a point beyond the tobacco introduction station in which the tobacco is conveyed upwardly by the hot moisturized air.

6. The apparatus of claim 5 wherein said tobacco is conveyed upwardly in at least one expansion chamber whereby the velocity of the air flowing through the apparatus is reduced.

* * * * *